US009814283B1

(12) United States Patent
Nemecek et al.

(10) Patent No.: US 9,814,283 B1
(45) Date of Patent: Nov. 14, 2017

(54) NOVELTY BUTTONS

(71) Applicant: PureButtons LLC, Medina, OH (US)

(72) Inventors: Jeffrey N Nemecek, Medina, OH (US); Joshua A Hippley, Akron, OH (US); Mitchell Monyak, Brunswick, OH (US)

(73) Assignee: PUREBUTTONS, LLC, Medina, OH (US)

( * ) Notice: Subject to any disclaimer, the term of this patent is extended or adjusted under 35 U.S.C. 154(b) by 0 days.

(21) Appl. No.: 15/617,433

(22) Filed: Jun. 8, 2017

(51) Int. Cl.
*A44C 1/00* (2006.01)
*G09F 23/00* (2006.01)

(52) U.S. Cl.
CPC ..... *A44C 1/00* (2013.01); *G09F 23/00* (2013.01); *A44D 2203/00* (2013.01)

(58) Field of Classification Search
CPC .. A44C 1/00; A44C 3/01; G09F 23/00; A44D 2203/00
USPC ..... 40/1.5
See application file for complete search history.

(56) References Cited

U.S. PATENT DOCUMENTS 684,491 A * 10/1901 Adams ..... A44C 3/001 24/103
2,336,184 A * 12/1943 Mitchel ..... A44C 3/001 40/1.5
2,340,402 A * 2/1944 Mitchel ..... A44C 3/001 40/1.5
4,130,956 A 12/1978 Eddy et al.
4,531,310 A * 7/1985 Acson ..... A44C 3/001 40/1.5
4,597,206 A * 7/1986 Benson ..... A44C 3/001 24/103
4,604,819 A * 8/1986 Grey ..... A44C 3/004 40/1.5
4,777,744 A 10/1988 Barnett
5,369,899 A * 12/1994 Reeves ..... A44C 3/001 24/303
5,862,615 A 1/1999 O'Rourke
6,263,702 B1 * 7/2001 Lo ..... A41F 11/06 24/516
6,269,574 B1 * 8/2001 Sokolofski ..... G09F 3/12 40/1.5
6,505,426 B2 1/2003 Yang
6,526,679 B1 3/2003 Wood
8,925,222 B2 1/2015 Peterson
2009/0064555 A1 * 3/2009 Schymura ..... A47G 1/0616 40/738
2010/0175286 A1 7/2010 Felix
2011/0047838 A1 * 3/2011 Peterson ..... G09F 3/207 40/1.5
2013/0097817 A1 * 4/2013 Hayton ..... A44B 11/06 24/303

(Continued)

OTHER PUBLICATIONS

Busy Beaver Button Co.; "Introducing: 6" Buttons!" Busy Beaver Button Co.; available at https://blog.busybeaver.net/2014/03/17/introducing-6-buttons, retrieved Apr. 22, 2016, pp. 1-3.

(Continued)

*Primary Examiner* — Gary C Hoge
(74) *Attorney, Agent, or Firm* — Pearne & Gordon LLP

(57) ABSTRACT

The present disclosure relates to novelty and promotional buttons. The button includes a magnet that is exposed through an opening in a button back to adhere the button to a ferrous metal substrate.

16 Claims, 6 Drawing Sheets

(56) References Cited

U.S. PATENT DOCUMENTS

| | | | | |
|---|---|---|---|---|
| 2014/0196330 | A1* | 7/2014 | Cook | A44C 3/004 40/594 |
| 2014/0259298 | A1* | 9/2014 | Esagoff | A41D 27/20 2/251 |
| 2015/0075329 | A1* | 3/2015 | Hay | A44C 3/001 79/4 |
| 2016/0309852 | A1* | 10/2016 | Krasney | A44B 6/00 |
| 2017/0006976 | A1 | 1/2017 | D'Ercole | |

OTHER PUBLICATIONS

Affordable Buttons; "Premium Custom Buttons Fast 6 Inch Round Buttons," Affordable Buttons; available at https://affordablebuttons.com/Custom-Buttons/products/round-6-button.html, retrieved Apr. 22, 2016, pp. 1-2.

* cited by examiner

NOVELTY BUTTONS

TECHNICAL FIELD

The present disclosure relates to novelty and promotional buttons. The button includes a magnet that is exposed through an opening in a button back capable to adhere the button to a ferrous metal surface.

BACKGROUND

Novelty and promotional buttons with text and/or graphics are widely used for promotional purposes. Conventional buttons include a front plate made of metal or plastic and a button back that are secured at the rear of the front plate. The text and/or graphics are engraved or printed on the front plate or are printed onto a sheet that overlies or is laminated to the front plate. Optionally, a transparent film or sheet is placed over the text and/or graphics. Edges of the front plate are usually folded back to form a circumferential rim that is crimped over the button back to secure it in place. The button back typically includes a mechanical fastener, such as a pin, for coupling the button to, for example, clothing.

The button back may also be prepared from a magnetic material, such as a flexible magnetic sheet, to adhere the button to a ferrous metal surface. The magnetic sheet is cut and arranged behind the front plate to form the button. However, the magnetic sheet is prone to deteriorate quickly and the magnetic attraction is often weak. Accordingly, these buttons often are of low quality.

To address this, stronger magnets sometimes are adhered to the button back via an adhesive. But the adhesive can crack or deteriorate, resulting in failure.

There is a need for a button that features a magnet with a strong magnetic charge that also has a professional appearance for use in promotional campaigns.

SUMMARY

In a first aspect, disclosed is a button. The button includes a plate having front and rear surfaces, a circumferential rim, and a cavity extending from the front surface toward the rear surface; a back element having front and rear surfaces and an opening that extends from the front surface to the rear surface, wherein the front surface of the back element is disposed against the rear surface of the plate; and a magnet between the back surface of the plate and the front surface of the back element that is exposed through the opening.

DETAILED DESCRIPTION

Herein, when a range such as 5-25 (or 5 to 25) is given, this means preferably at least 5 and, separately and independently, preferably not more than 25.

Figure 1:
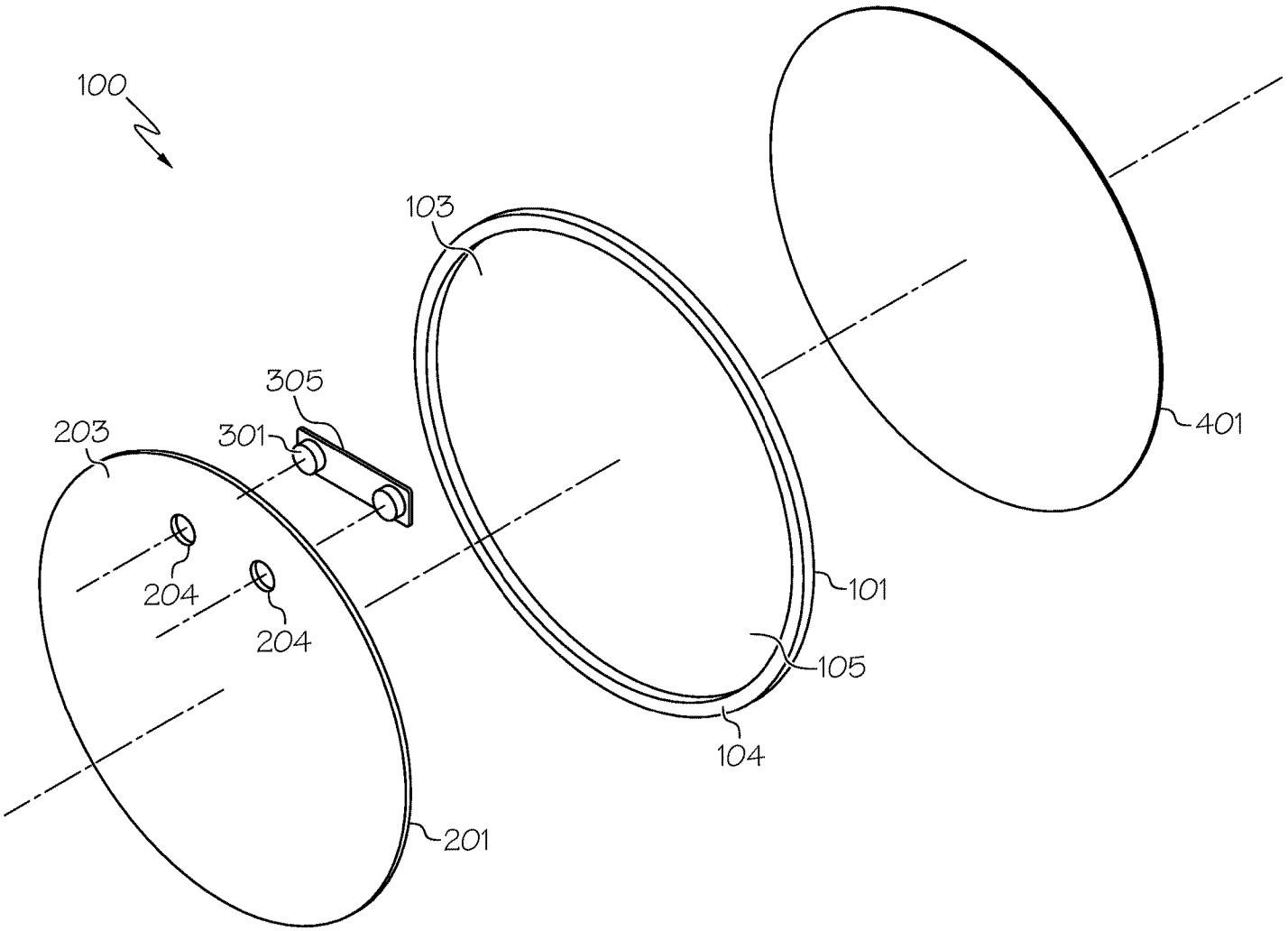
FIG. 1 is an exploded perspective view of a button as disclosed herein.

FIG. 1 illustrates an exploded view of a button 100. The button 100 includes a front plate 101, a button back 201, and a magnet 301. Text and/or graphics may be engraved or printed on the plate front surface 102 (seen in FIG. 2). In another embodiment, the plate 101 supports a graphic layer 401 (such as printed paper) that includes the text and/or graphics for display. Optionally, a transparent layer (not shown) is disposed over the text and/or graphics for protection and durability. Once the individual components are assembled, they are inserted into a crimping press where they are pressed together with the plate 101 and optional graphic layer 401 and transparent layer overwrapping the perimeter edge of the button back 201.

The plate 101 may be substantially flat or slightly domed. The plate 101 includes front and rear surfaces 102 and 103, and a circumferential rim 104 that extends rearward and defines a recess 105 formed at the rear surface 103 of the plate 101. The plate 101 may be prepared from paper, plastic, or metal, including ferrous and non-ferrous metals. In one embodiment the plate 101 is stamped from sheet metal. In another embodiment the plate 101 is injection molded from plastic.

Figure 2A:
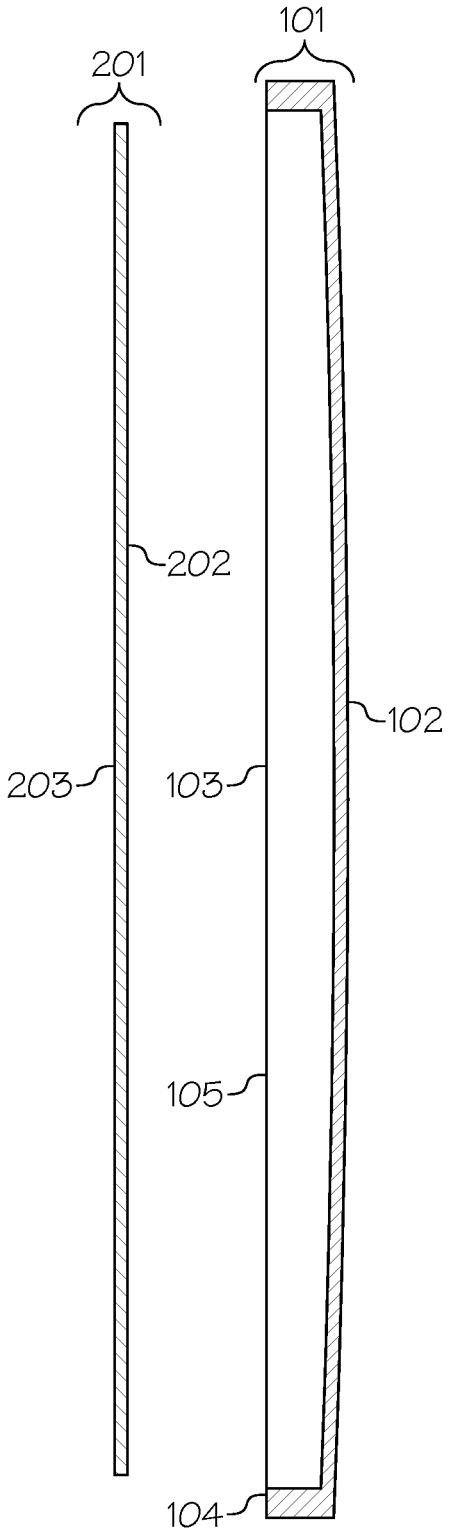
FIG. 2 is a side, cross-sectional view of the button, showing the button back separated from (FIG. 2A) and against (FIG. 2B) the rear surface of the plate.
Figure 2B:
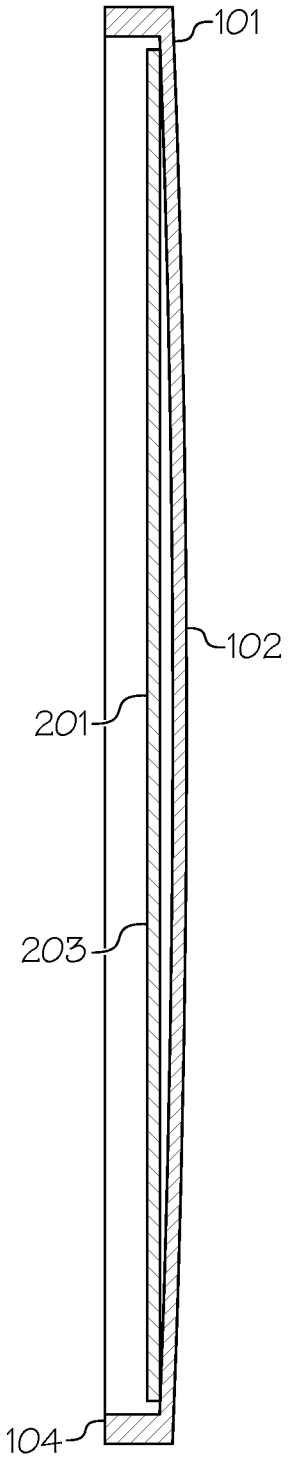

The button back 201 includes one or more openings 204 that extend from a front surface 202 to a rear surface 203 of the button back 201. In one embodiment, the button back 201 is disposed in the recess 105 of the plate 101, wherein the back element front surface 202 is arranged against the plate back surface 103 as shown in FIG. 2. Once the button back 201 is arranged in this manner, the circumferential rim 104 may be crimped over the perimeter edge of the button back 201 to secure the button back 201 within the recess 105 of the plate 101. The button back 201 may be prepared from a paper, plastic, or metal.

Figure 3:
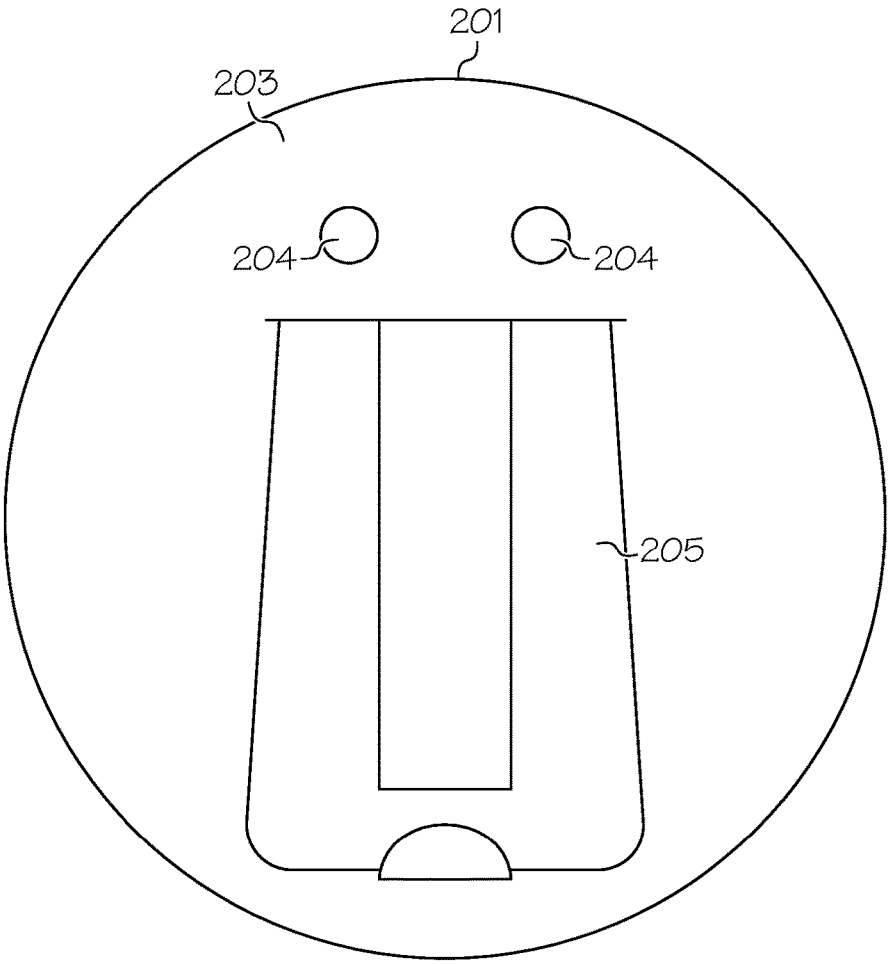
FIG. 3 is a rear view of the button.
Figure 4:
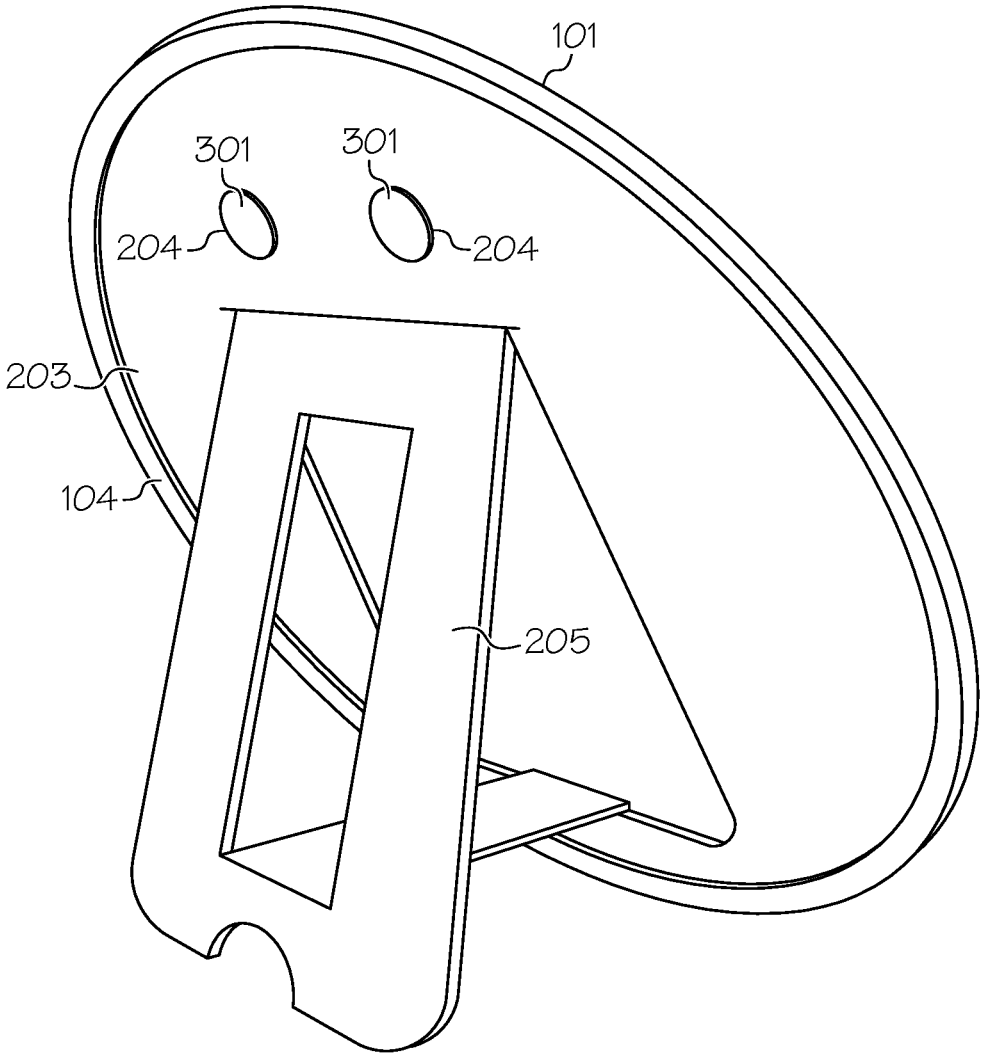
FIG. 4 is a rear perspective view of the button of FIG. 3 with an extended easel arm.
Figure 5:
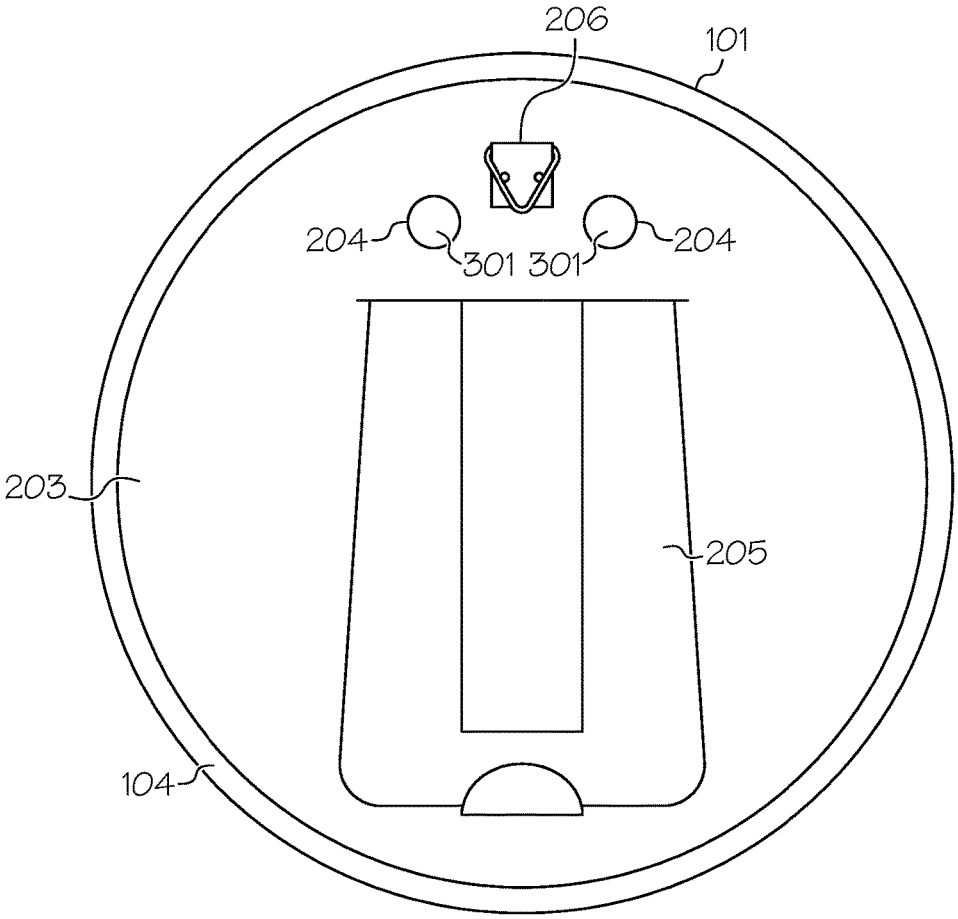
FIG. 5 is a rear view of a button according to a further embodiment hereafter described.

The button back 201 can further include an easel arm 205 that pivots outward from the button back rear surface 203 to stand the button 100 on a surface such as a table, as shown in FIGS. 3, 4, and 5.

Figure 6:
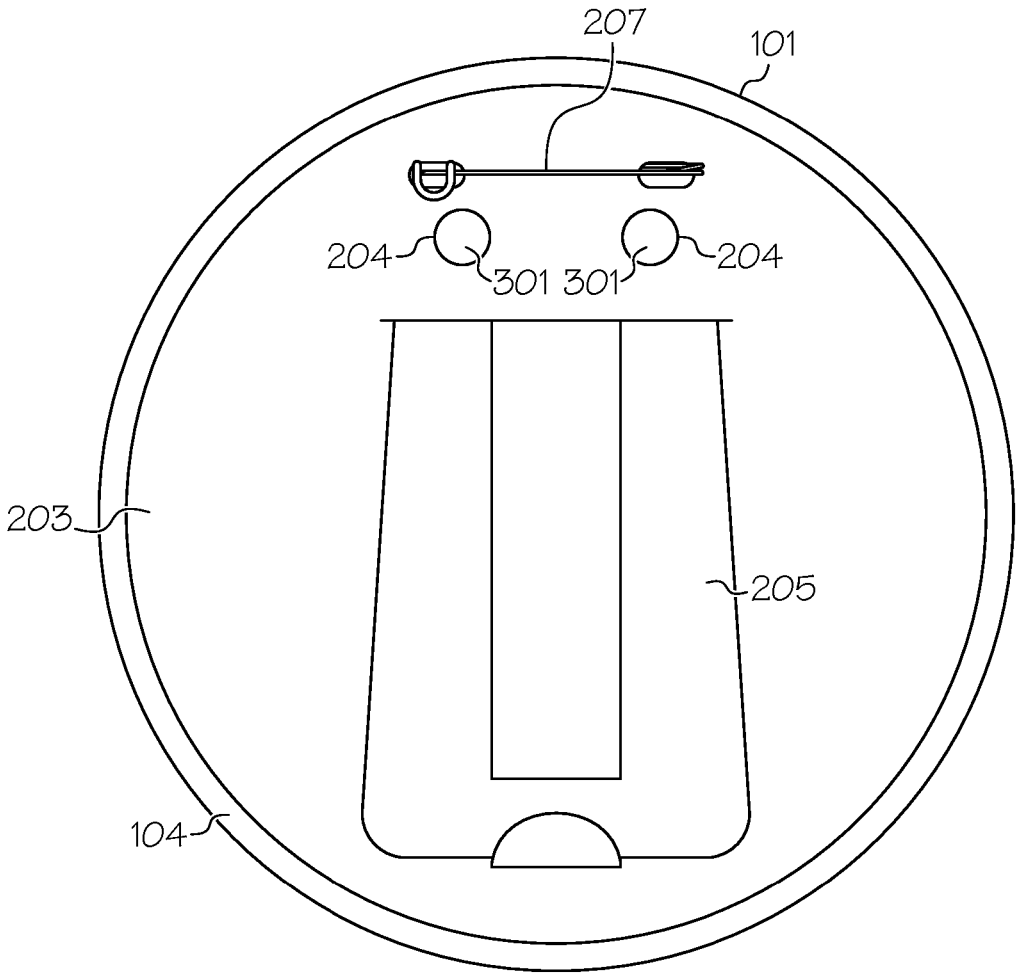
FIG. 6 is a rear view of a button according to a further embodiment hereafter described.

In one embodiment, the button 100 includes a fastener for fastening the button 100 to clothing or another surface. The fastener can be any number of common fasteners, such as a clip, a pin 207 and clasp as shown in FIG. 6, or a hook 206 as shown in FIG. 5.

At least one magnet 301 extends in an associated opening 204 in the button back 201 from between the plate rear surface 103 and the button back front surface 202, preferably protruding from the button back rear surface 203. In the illustrated embodiment, two such magnets 301 are provided protruding via respective openings 204, and are supported on a common magnet-support bar 305 disposed between the button back 201 and the front plate 101. In this embodiment, respective outer surfaces of the magnets 301 stand proud of the button back rear surface 203. Alternatively, the exposed surface(s) of one or both of the magnets 301 can be exposed through the opening(s) 204 yet remain flush with the button back rear surface 203.

The magnet(s) 301 may be fitted within the respective opening(s) 204 via an interference fit. Alternatively, it/they may be adhered to the button back 201 via an adhesive; e.g. between the magnet(s) and the button back 201 directly, or between the magnet-support bar 305 and the button back front surface 202.

The button 100 can include a transparent film (not shown) to protect the text and/or graphics. The transparent film (when present) is disposed over (e.g. laminated to) the graphic layer 401 or the plate front surface 102. In another embodiment, both sides of the graphic layer 401 are laminated with a transparent film. The transparent film is made from a conventional clear plastic material.

The button 100 may be provided with a ferrous metal anchoring bar (not shown) for magnetically attaching the button 100 to clothing. The ferrous bar can be placed at the inside surface of a clothing item or garment and attracted to the magnet 301 disposed at the outside surface thereof for securing the button 100 to the clothing.

Optionally, the button 100 includes a textured, soft-touch matte finish, such as that of velvet or suede, on the plate front surface 102 through which indicia printed or applied thereon is visible. In another embodiment, the button 100 includes a textured, soft-touch matte finish on the graphic layer 401.

Optionally, the button 100 includes a glossy finish on the plate front surface 102 through which indicia printed or applied thereon is visible. In another embodiment, the button 100 includes a glossy finish on the graphic layer 401.

Although the illustrated embodiments show circular buttons, the novelty and promotional buttons may be in any shape, including triangles, quadrilaterals, polygons, ellipses, and crescents. In desirable embodiments the button 100 is a novelty item having a diameter of approximately six inches, less preferably a diameter of approximately five to seven inches, even less preferably a diameter of approximately four to eight inches. However, other dimensions and diameters can be used.

Typically the button back 201 has an overall lateral dimension (i.e. diameter when button back 201 is circular) that is smaller than the corresponding dimension of the front plate 101. This allows the button back 201 to be received in the recess 105 defined at the rear of the front plate 101 and to be crimped by the circumferential rim 104 thereof.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the claims.

The invention claimed is:

1. A button comprising:

a front plate having a circumferential rim and a recess disposed at a rear surface thereof;

a button back having an opening that extends from a front surface thereof to a rear surface thereof; and a magnet extending in said opening from a location between said button back and said front plate such that a surface of said magnet is exposed from said rear surface.

2. The button of claim 1, wherein the exposed surface of said magnet stands proud of said rear surface of said button back.

3. The button of claim 1, said surface of said magnet being flush with said rear surface.

4. The button of claim 1, the magnet being a neodymium magnet.

5. The button of claim 1, further comprising an adhesive adhering the magnet to the button back.

6. The button of claim 1, further comprising a ferrous metal bar attracted to the magnet that is exposed through the opening in the button back.

7. The button of claim 1, wherein a diameter of the plate being greater than a diameter of the button back.

8. The button of claim 1, the circumferential rim being crimped over a perimeter edge of said button back.

9. The button of claim 1, further comprising a textured, soft-touch matte finish on a front surface of the plate through which indicia printed or applied thereon is visible.

10. The button of claim 1, further comprising a textured, soft-touch matte finish being applied via a label overlaid on a front surface of the plate.

11. The button of claim 1, further comprising a glossy finish on a front surface of the plate through which indicia printed or applied thereon is visible.

12. The button of claim 1, further comprising a glossy finish being applied via a label overlaid on a front surface of the plate.

13. The button of claim 1, further comprising a hook or a pin affixed to the rear surface of the button back.

14. The button of claim 1, further comprising a hook affixed to the rear surface of the button back and an easel arm that pivots outward from the rear surface of the button back.

15. The button of claim 1, further comprising a textured, soft-touch matte finish on a front surface of the plate through which indicia printed or applied thereon is visible, a hook affixed to the rear surface of the button back, and an easel arm that pivots outward from the rear surface of the button back.

16. A button of comprising:

a front plate having a circumferential rim and a recess disposed at a rear surface thereof;

a button back having a first opening and a second opening, both of which extend from a front surface thereof to a rear surface thereof; and a first magnet and a second magnet extending in said first and second openings, respectively, from a location between said button back and said front plate such that respective surfaces of said first and second magnets are exposed from said rear surface.

* * * * *